US005338408A

United States Patent [19]

Marx, Jr.

[11] Patent Number: 5,338,408

[45] Date of Patent: Aug. 16, 1994

[54] PAPER FORMING UNIT WITH TWO DANDY ROLLS

[75] Inventor: Edmund N. Marx, Jr., St. Marys, Ga.

[73] Assignee: Gilman Paper Company, St. Marys

[21] Appl. No.: 15,525

[22] Filed: Feb. 9, 1993

[51] Int. Cl.[5] ..... D21F 1/00

[52] U.S. Cl. ..... 162/301; 162/203; 162/300; 162/348

[58] Field of Search ..... 162/203, 217, 300, 301, 162/348

[56] References Cited

U.S. PATENT DOCUMENTS

| | | | |
|---|---|---|---|
| 3,810,818 | 5/1974 | Arledter | 162/301 |
| 3,819,474 | 6/1974 | Holz | 162/DIG. 7 |
| 4,406,739 | 9/1983 | Kankaanpaa | 162/301 |
| 4,425,187 | 1/1984 | Armstrong | 162/300 |
| 4,459,175 | 7/1984 | Bubik et al. | 162/352 |
| 4,472,244 | 9/1984 | Haltsonen | 162/301 |
| 4,561,938 | 12/1985 | Kallmes | 162/301 |

FOREIGN PATENT DOCUMENTS 287276 10/1988 European Pat. Off. ..... 162/348

*Primary Examiner*—Karen M. Hastings
*Attorney, Agent, or Firm*—Arthur G. Yeager

[57] ABSTRACT

In a Fourdrinier paper making system where all of the water from the stock slurry is removed in one direction downwardly through the paper web, a sheet forming unit, including two spaced dandy rolls with a pocket roll inbetween, is added to press a secondary fabric downwardly on the top surface of the paper web. The pocket roll cooperates with a suction box below the paper web to remove water while the web passes over a low vacuum section and then over a high vacuum section and then over a low vacuum section of the suction box. This treatment produces a better internal bond between the fibers in the paper web and also produces better surface properties.

19 Claims, 5 Drawing Sheets

PAPER FORMING UNIT WITH TWO DANDY ROLLS

BACKGROUND OF THE INVENTION

In the papermaking process, a slurry of cellulose fiber called "stock" containing approximately 99½% water is delivered by means of pumps to the paper machine headbox. From the headbox, the slurry is distributed to a moving fabric on the paper making machine called a Fourdrinier machine. On the Fourdrinier machine the stock slurry is dewatered from tile 99½% to approximately 22% by means of suction boxes and/or foil units, etc. During this dewatering period, the papermaker must use whatever equipment and means are available to form the fibers into an acceptable sheet of paper.

There are many devices and versions of the Fourdrinier machine on the market today to make a better sheet at higher speeds. The present invention is unique because it can perform this task at a much lower price while maintaining greater strength in the sheet of paper.

There are several "top wire formers" on the market today that increase speed and make a better looking and flatter sheet. All of them do about the same thing but with different configurations. In order to make the sheet less "two-sided" (i.e. having less differences in appearance and smoothness on the two sides of the paper), these prior art procedures dewater the sheet from both sides (i.e. vacuum units remove the water from above as well as from below the sheet).

In the opinion of many papermakers, dewatering from both sides does make for a less "two-sided" sheet, but at the same time, it reduces the internal bond strength between the fibers in the sheet. When vacuum or foil units exert enough energy into the still tender sheet to remove water from both sides, it also destroys the bonds between fibers which are very important in the early part of the Fourdrinier process in forming a quality paper sheet.

It is an object of this invention to provide a process that increases the bonds between fibers in the sheet, and at the same time produces a sheet that is not "two-sided". It is another object of this invention to provide a process wherein all water is removed from one side of the paper web which is formed between two opposing pressurized sheet-forming fabrics. Still other objects will become apparent from the more detailed description which follows.

BRIEF SUMMARY OF THE INVENTION

This invention relates to an improvement in a Fourdrinier paper-making process including a moving main fabric supporting a web of paper fibers with water being removed from tile web from underneath the fabric, wherein the improvement comprises a surface finishing unit including two dandy rolls, an adjustable stretch roll and a pocket roll driving a secondary fabric which presses down from above against tile web on tile main fabric, and cooperating with a two-chambered suction box having high and low vacuum sections, respectively, located below the main fabric and under the pocket roll.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with tile accompanying drawings which:

DETAILED DESCRIPTION OF THE INVENTION

Figure 1:
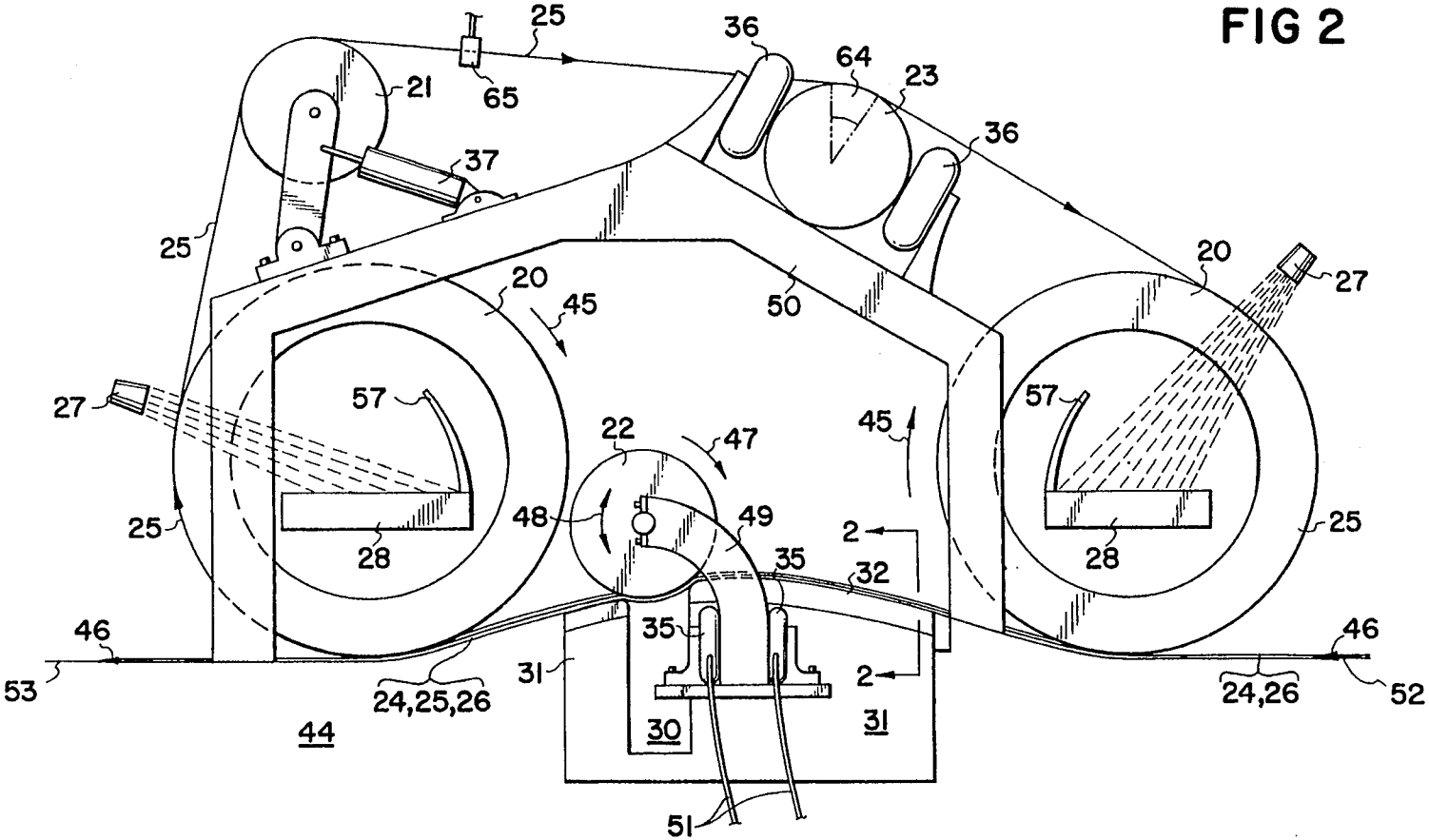
FIG. 1 is a schematic elevational drawing of tile apparatus performing the process of this invention.

The invention is best understood by reference to the attached drawings. In FIG. 1 the overall invention can be seen.

This invention is all additional process step and apparatus unit to a Fourdrinier paper-making machine in the area of the paper-forming step downstream from the headbox where a slurry of paper fibers is spread over a traveling wirescreen or fabric upon which the paper is formed. After passing the first suction boxes or foils the tender paper web is formed on the main fabric and can be subjected to the process and apparatus of this invention. Main fabric 24 with a wet paper web or sheet 26 enters this invention at 52 and leaves it at 53.

Figure 2:
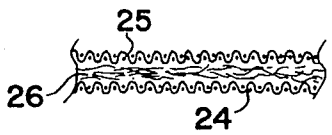
FIG. 2 is a cross-sectional view taken at 2—2 of FIG. 1.

The principal apparatus components of this invention include two spaced dandy rolls 20, a stretch roll 21, a pocket roll 22, and a guide roll 23, which drive and support a secondary fabric 25 substantially identical to, and considerably shorter than, main fabric 24. All of the above rolls and secondary fabric are positioned above main fabric 24 and web 26 with dandy rolls 20 pressing secondary fabric 25 lightly against the upper exposed surface of web 26. Both fabrics 24 and 25, as well as web 26 move at the same speed in the direction of arrows 46 from right to left in FIG. 1. Between dandy rolls 20 is suction box 29 positioned below main fabric 24. Suction box cover 32 is a support for main fabric 24 which slides over and is contiguous to cover 32. Cover 32 preferably is made of ceramic or polyurethane material. As will be described below in detail, cover 32 has vertical passageways therethrough for water to flow from web 26 into the interior of suction box 29. There are two sections in suction box 29, a high vacuum section 30 in the middle of suction box 29 and a low vacuum section 31 both upstream and downstream from section 30; which therefore, subjects web 26 in its passage over suction box 29 to a low vacuum (e.g., 4–8 inches of mercury), then to a high vacuum (e.g., 10–15 inches of mercury), and then back to a low vacuum (e.g., 4–8 inches of mercury) before it ends its contact with suction box 29. The side view of suction box 29 shows it to be slightly arched and with pocket roll 22 pressing downwardly on the arched surface as it passes over the high vacuum section 30. Roll 22 preferably has a main body 54 of rubber or polyurethane (225 P&J hardness) covered with a soft fibrous material 55. Pocket roll 22 is supported by a bracket 49 which causes roll 22 to move in the direction of arrow 48 as pneumatic diaphragm controllers 35 are pressurized or depressurized through pressurized air or other gas in lines 51. Roll 22 rotates in the direction of arrow 47 squeezing water from web 26 and pressing a surface finish into web 26. Stretch roll 21 serves to stretch secondary fabric 25 and is adjusted by the action of pneumatic cylinder 37. Guide roll 23 is included to maintain secondary fabric 25 in the proper linear alignment as it moves about dandy rolls 20, stretch roll 21 and pocket roll 22. Guide roll 23 can be aligned as required by a pair of pneumatic diaphragms 36 at one end of the guide roll 23. Preferably, there should be a wrap around of secondary fabric 25 on guide roll 23 of about 25° as shown at 64. Guide paddle 65 which senses any changes in the position of the edge of fabric 25 signals diaphragms 36 to adjust roll 23 to proper alignment. Dandy rolls 20 have a fine screen-like surface and will normally pick up paper fibers in its use, and these fibers or clusters of fibers must be removed to allow dandy rolls 20 to perform properly with the secondary fabric 25 in order to provide a good surface appearance to the upper surface of web 26. For this reason a water spray 27 is directed inwardly against each dandy roll 20 to clean its outer surface the spray water is collected internally of each dandy roll 20 in a savall pan 28, preferably with splash guards 57. The entire unit is supported on the frame 44 of the Fourdrinier machine or on the floor of the plant. Any unit frame 50 may be employed to maintain rolls 20, 21, 22 and 23 in appropriate positions. FIG. 2 shows a cross-section of tile sandwich of secondary fabric 25 on top, wet web of paper 26 in the middle, and main fabric 24 on the bottom.

Figure 3:
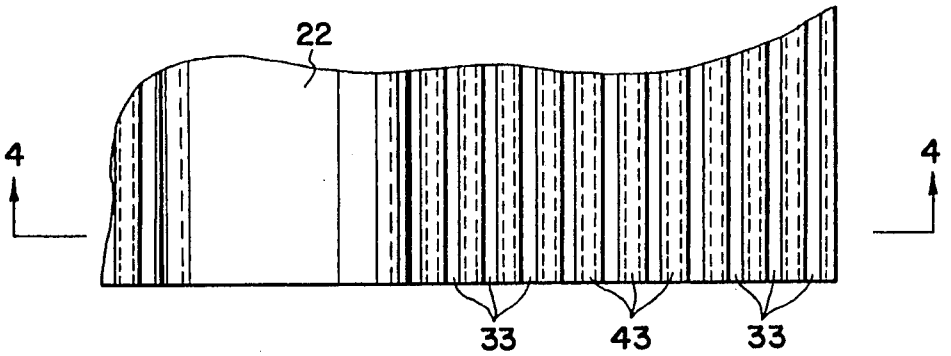
FIG. 3 is a top plan view of the suction box and pocket roll used in the process of this invention.
Figure 4:
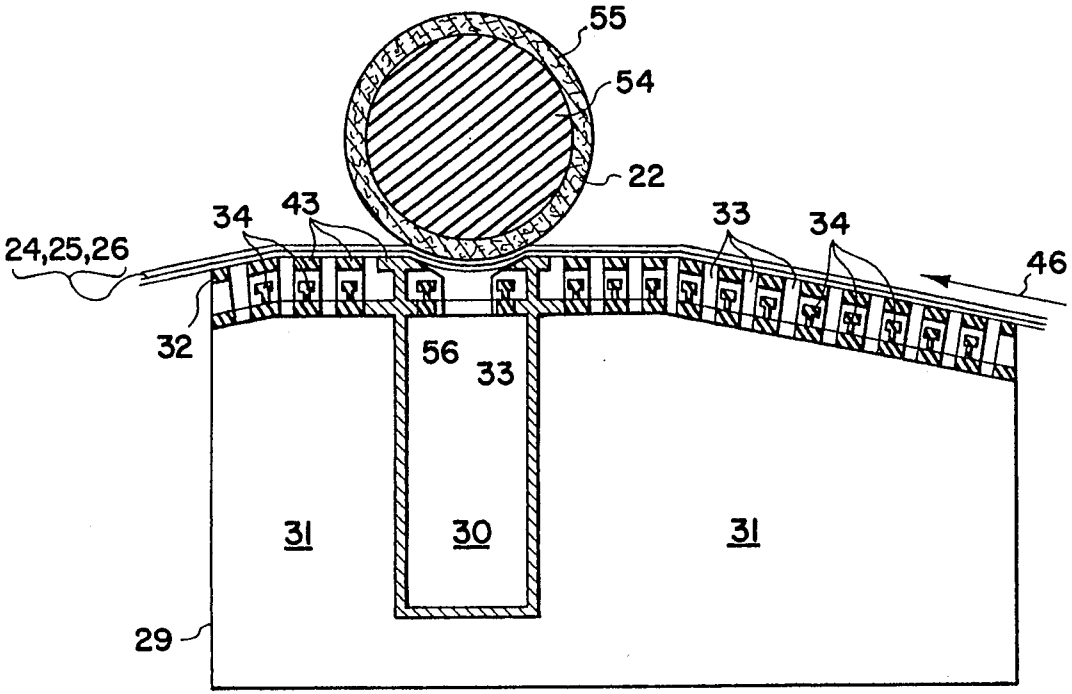
FIG. 4 is a cross-sectional view taken at 4—4 of FIG. 3.
Figure 5:
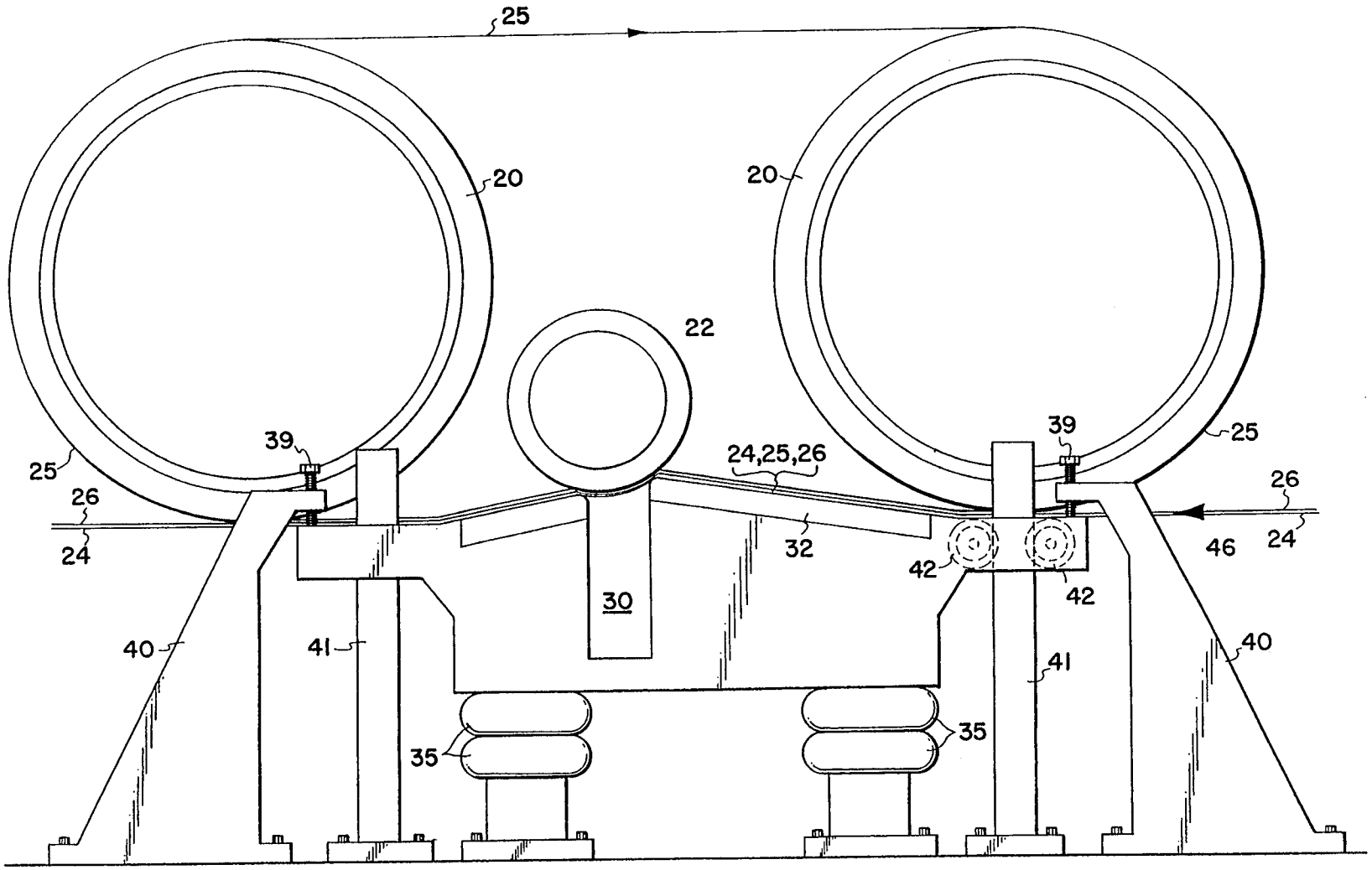
FIG. 5 is a side elevational view of the suction box and pocket roll used in the process of this invention.

FIGS. 3 and 4 more clearly depict some of the detail of suction box 29 and operation of tile pocket roll 22. The cover 32 of suction box 29 must be porous so as to allow water to flow easily from wet web 26 into suction box 29 interior for removal. Cover 32 has a plurality of parallel foils 43 with open spaces 33 (about 0.375 to 0.50 inch) between adjacent foils 43. T-bars 34 stretch from side to side across the open top of suction box 29. Each foil 43 has a T-slot to fit over T-bars 34 for lateral support. Suction box 29 is made with portion 30 sealed off from the remaining interior 31. This permits a high vacuum to be applied in section 30 and a low vacuum in section 31. Thus, as the sandwich of main fabric 24, wet web 26, and secondary fabric 25 moves across suction box 29 in the machine running direction 46, the sandwich is first subjected to low vacuum (e.g., 4–8 inches of mercury), then to high vacuum (e.g., 10–15 inches of mercury), and then back to low vacuum (e.g., 4–8 inches of mercury). Pocket roll 22 presses down into a central wide opening 56 between adjacent foils 43 above the high vacuum in section 30.

FIGS. 5–8 show the support system for the forming unit of this invention. The sandwich of main fabric 24, wet web 26, and secondary fabric 25 pass through the forming unit from right to left in the direction of arrow 46. Dandy rolls 20 bring secondary fabric 25 into tile sandwich at tile right hand side of FIG. 5 and take it away from the sandwich at the left hand side of FIG. 5. In between rolls 20 the sandwich passes over suction box 29 and its cover 32. The cover 32 is arched to tighten the sandwich against cover 32 when rolls 20 both are in place. The supporting framework under suction box 29 provides the upward force to make the sandwich tight against rolls 20 and cover 32 while pocket roll 22 adds to that tightness. Suction box 29 is supported upstream and downstream by diaphragms 35 which are inflated by fluid pressure, i.e., hydraulically or pneumatically, to push suction box 29 upwardly. In specific embodiments disphragms may be at each of the four corners of suction box 29 to provide maximum adjustability. In other embodiments only two pairs of diaphragms may be needed to provide adjustment to the upstream and downstream edges at suction box 29. Columns 41 and rollers 42 guide suction box 29 in its upward and downward movement. Stop brackets 40 and stop screws 39 are adjustable to prevent undue upward movement. This arrangement provides a centering and equalizing force to cause diaphragm 35 to allow the adjustment of suction box 29 and sandwich 25-26-24 to be properly compressed. Rolls 20 are journaled at each end in bearings 58, preferably ball bearings, supported in bearing housings 59, which contain appropriate seals (not shown) to prevent water and dust from entering the bearings.

Figure 6:
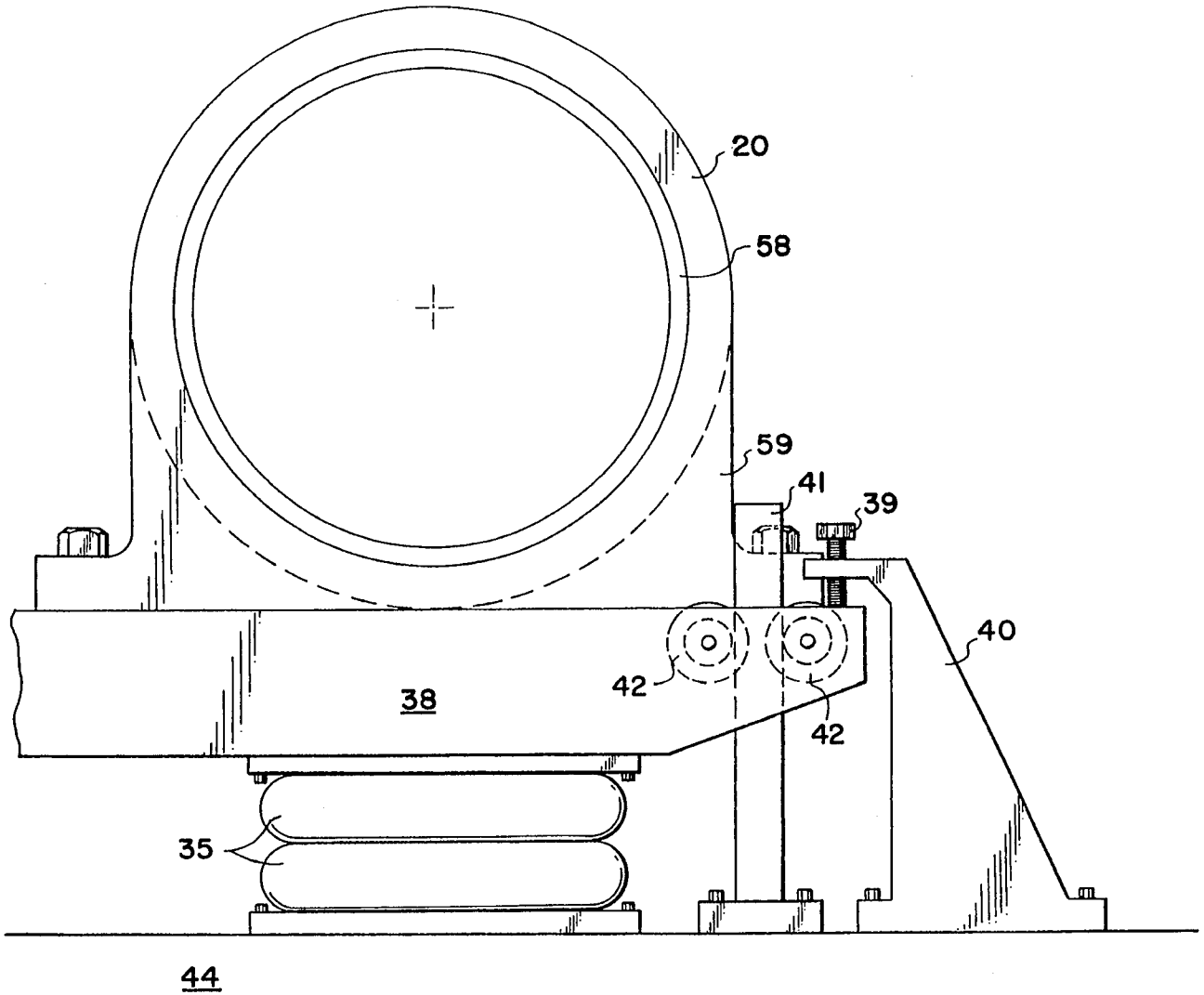
FIG. 6 is an enlarged elevational view of the pressurizing means for raising and lowering the dandy rolls and for centering the suction box used in the process of this invention.
Figure 8:
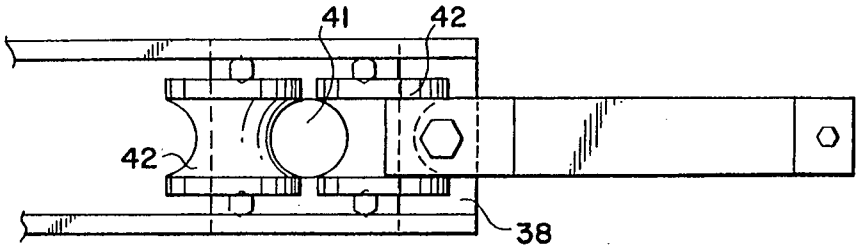
FIG. 8 is a top plan view of the centering means used in this invention.
Figure 7:
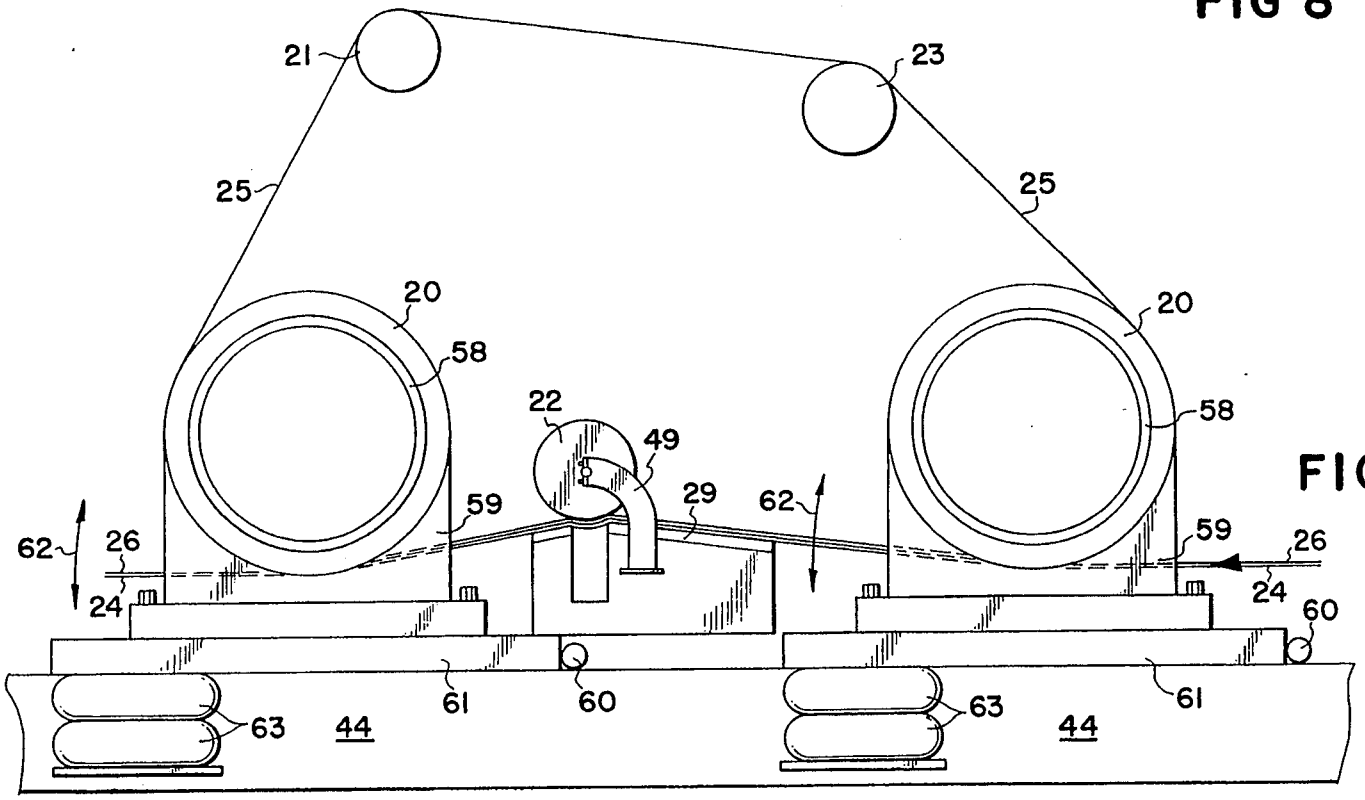
FIG. 7 is an elevational view of a second embodiment for raising and lowering the dandy rolls used in this invention.

FIG. 7 illustrates an optional addition to the supporting frame of FIG. 6. The same arrangement of rolls 20, 21, 22 and 23; suction box 29 is shown. Each dandy roll 20 is mounted in a bearing housing 59 and a bearing 58, which, in turn, is firmly attached to a pivoting support plate 61, pivoted at 60 from main frame 44 and movable in the direction of arrows 62. This arrangement allows for movement of plate 61 and roll 20 by reason of hydraulic or pneumatic pressure in diaphragms 63, as an additional adjustment to that FIG. 6.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In a Fourdrinier paper-making system including a generally horizontal moving main fabric supporting a web of paper fibers with water being removed from the web solely from underneath the main fabric, the improvement which comprises a surface finishing unit including two spaced dandy rolls, an adjustable stretch roll and a pocket roll driving a secondary fabric which is located above said main fabric, said dandy rolls structured and arranged for pressing said secondary fabric down from above against said web on said main fabric, said pocket roll being smaller than and located between said dandy rolls, a two-chambered suction box having low, high, and low vacuum sections, structured and arranged to be successively applied to said web from below said main fabric and under said pocket roll.

2. The system of claim 1 wherein said stretch roll is pushed against said secondary fabric by an adjustable means to provide tension in said secondary fabric.

3. The system of claim 2 wherein said suction box has a top cover which contacts said main fabric, said top cover having a plurality of spaced lateral passageways for water to flow from said web to within said suction box.

4. The system of claim 1 wherein said suction box is pushed upwardly against said main fabric by adjustable diaphragm means.

5. The system of claim 1 wherein said pocket roll is structured and arranged to forcibly push downwardly against said secondary fabric to press said secondary fabric against said web as it passes over the high vacuum section of said suction box.

6. The system of claim 5 further comprising diaphragm means for adjusting the force applied by said pocket roll against said secondary fabric.

7. The system of claim 1 further comprising a water spray directed through said secondary fabric at each of said dandy rolls to dislodge any fibers clinging to said secondary fabric and said dandy rolls before said secondary fabric is pressed against said web.

8. In a Fourdrinier paper-making system including a horizontally travelling main fabric with suction means thereunder to assist in removing water from the lower surface of an aqueous web of paper fibers having an upper surface and a lower surface and resting on said main fabric, the improvement which comprises a secondary fabric above pressing down on said upper surface over a short running length of said main fabric, said secondary fabric being supported, guided and driven by the combination of two spaced dandy rolls structured and arranged for pressing said secondary fabric against said web, a stretch roll to adjust the tension of said secondary fabric, and a pocket roll smaller than and between said dandy rolls structured and arranged to press said secondary fabric against said web, and a suction box located below said main fabric and below and opposite said pocket roll, said suction box being structured and arranged to provide a section of high vacuum and a section of low vacuum to said web.

9. In a Fourdrinier paper-making machine having a paper forming section with a horizontal traveling main fabric with an aqueous web of paper-making fibers carried by the main fabric and water removal means underneath the main fabric removing water by suction means, the improvement which comprises an endless travelling secondary fabric essentially identical to the main fabric and positioned above and contiguous to the aqueous slurry, a suction box below and contiguous to the main fabric, the secondary fabric being driven and supported by two spaced dandy rolls structured and arranged for pressing said secondary fabric against said web, a stretch roll and a pocket roll smaller than and located between said dandy rolls which is structured and arranged to press the secondary fabric downwardly against said web resting on the main fabric, said secondary fabric and main fabric passing over said suction box, said suction box including means defining successive areas of low vacuum, high vacuum and low vacuum underneath the main fabric, said pocket roll structured and arranged for pressing said secondary fabric downwardly opposite said area of high vacuum.

10. A former for a main paper making machine, said former comprising a supporting framework, a pair of spaced dandy rolls rotatably mounted to said framework, an adjustable stretch roll, a guide roll, and a pocket roll being smaller than said dandy rolls and being mounted to said framework and located generally between said dandy rolls, a secondary fabric extending about said dandy, stretch, guide, and pocket rolls, said secondary fabric being generally the same as a Fourdrinier main fabric for supporting a web of paper fibers and water thereon, said dandy rolls structured and arranged for pressing said secondary fabric toward a Fourdrinier main fabric with a web of paper fibers sandwiched therebetween, said secondary fabric being driven to coordinate with movement of a Fourdrinier main fabric, means for adjusting said stretch roll to correspondingly adjust tension of said secondary fabric, suction means being mounted to said framework and disposed spacedly below said pocket roll and structured for engaging a Fourdrinier main fabric, said suction means including a high vacuum means opposite said pocket roll, said pocket roll being structured and arranged for pressing against said secondary fabric to cause enhanced dewatering of a web of paper supported on a Fourdrinier main fabric, said suction means including a low vacuum means immediately upstream and immediately downstream from said high vacuum means.

11. The former of claim 10 wherein said high and low vacuum means of said suction means is defined by a two-chambered suction box having a generally medial compartment of high vacuum and a compartment of low vacuum upstream and downstream from said medial compartment.

12. The former of claim 11 further comprising adjustable means for selectively forcing said suction box towards and away from said pocket roll.

13. The former of claim 11 wherein said suction box includes a cover adapted to contact a Fourdrinier main fabric, said cover having a plurality of spaced lateral foils over said high and said low vacuum compartments.

14. The former of claim 13 wherein said guide roll includes adjustment means for moving one end of said guide roll with respect to the other end.

15. The former of claim 10 further comprising adjustable means for selectively pressurizing said pocket roll against said secondary fabric.

16. The former of claim 10 further comprising water spray means directed at each said dandy roll and said secondary fabric to dislodge any fibers clinging thereto during rotational movement thereof.

17. The former of claim 10 further comprising an elongated pan located within each said dandy roll for recovering fiber and water from said water spray means cleansing said secondary fabric and said dandy rolls.

18. The former of claim 10 further comprising two pivotable plates supporting said two dandy rolls, respectively, and adjustable means for pivoting each said dandy roll toward and away from said main fabric.

19. The former of claim 10 wherein each said dandy roll, pocket roll, and guide roll is adjustably positioned by diaphragms containing fluid under pressure.

* * * * *